US005261175A

United States Patent [19]

Gebka

[11] Patent Number: 5,261,175

[45] Date of Patent: Nov. 16, 1993

[54] PRODUCT INFORMATION TAG FOR GRID HOOKS

[75] Inventor: John Gebka, Chicago Heights, Ill.

[73] Assignee: Fast Industries, Inc., Ft. Lauderdale, Fla.

[21] Appl. No.: 755,843

[22] Filed: Sep. 6, 1991

[51] Int. Cl.[5] ..... G09F 3/10

[52] U.S. Cl. ..... 40/299; 40/124.1; 40/657

[58] Field of Search ..... 40/124.4, 124.1, 657, 40/662, 663; 211/59.1; 248/220.4

[56] References Cited

U.S. PATENT DOCUMENTS

| | | | |
|---|---|---|---|
| 4,143,772 | 3/1979 | Bond | 211/59.1 |
| 4,463,510 | 8/1984 | Windish | 40/124.4 |
| 4,525,944 | 7/1985 | Fast | 40/124.1 |
| 4,583,308 | 4/1986 | Taub | 40/124.1 |
| 4,646,454 | 3/1987 | Fast | 40/124.1 |
| 4,665,639 | 5/1987 | Fast | 40/124.1 X |
| 4,671,002 | 6/1987 | Fast . | |
| 4,693,024 | 9/1987 | Fast | 40/124.1 |
| 4,694,595 | 9/1987 | Fast | 40/124.1 |
| 4,698,929 | 10/1987 | Fast | 40/124.1 |
| 4,703,570 | 11/1987 | Fast | 40/657 |
| 4,715,135 | 12/1987 | Fast . | |
| 4,754,563 | 7/1988 | Fast | 40/657 |
| 4,773,172 | 9/1988 | Fast | 40/657 |
| 4,882,868 | 11/1989 | Fast | 40/657 |
| 4,888,897 | 12/1989 | Fast | 40/657 |
| 4,987,692 | 1/1991 | Fast | 40/657 |
| 5,040,316 | 8/1991 | Fast | 40/124.1 |
| 5,109,992 | 5/1992 | Miller | 211/59.1 |
| 5,123,189 | 6/1992 | Fast et al. | 40/657 |

*Primary Examiner*—Kenneth J. Dorner
*Assistant Examiner*—Cassandra Hope Davis
*Attorney, Agent, or Firm*—Jacobson, Price, Holman & Stern

[57] ABSTRACT

An elongate produce information display tag for presenting product information at the distal end of a product support hook is useful on both wire-back hooks and plate-back hooks. The tag has a mounting portion with selective apertures by which the tab is engaged on the hook. One of the apertures is associated with a strip of contact adhesive extending across the mounting portion by which the tag can be adhered to the front surface of a back plate of a plate-back hook. The other aperture merges into a keyhole-type slot which can be used to embrace over the depending leg at the back of a hook by which the hook is welded to a back plate or rod-like bracket. The intermediate portion of the tag which extends over the hook has a fold down stabilizing tab which engages the hook and provides lateral stabilization of the tag.

14 Claims, 2 Drawing Sheets

PRODUCT INFORMATION TAG FOR GRID HOOKS

BACKGROUND OF THE INVENTION

This invention relates to product identification and information tags for merchandise suspended from elongate horizontally orientated support hooks and the like. More particularly, the invention relates to such tags which may be readily attached to and removed from the support hooks without being subject to inadvertent removal, and which display product information forwardly of merchandise supported on a hook.

In recent years, there have been designed, for example, a number of elongate product information and identification tags, generally made of plastic sheet, for displaying the product information forwardly of items suspended from horizontal hooks which may extend, for example, from apertured support boards and the like. Examples of such earlier tags may be found, for example, in prior U.S. Pat. Nos. 4,525,944; 4,646,454; 4,665,639; 4,693,024; 4,698,929; 4,703,570 and 4,715,135.

Generally, tags of the above kind include a mounting portion for attachment to and removal from the hook at a location adjacent the proximal end of the hook, an elongate intermediate portion extending forwardly from the mounting portion along the length of the hook and the merchandise suspended therefrom, and a display portion at the distal end of the intermediate portion for the display of product information and the like.

The tags disclosed in the above noted patents are provided with mounting portions suited for different applications to different types of hooks and mountings. Frequently, for example, the support hooks may be adapted to attach to supports other than apertured boards. For example, there are in existence elongate product support hooks having mounting brackets at their proximal ends which are particularly adapted for attachment to a flat transversely extending bar or to spaced rods forming part of a grid. In other prior U.S. Pat. Nos., notably U.S. Pat. Nos. 4,773,172 and 4,987,692, there are disclosed product identification tags having mounting portions particularly suited for use with hooks of this type.

It is an object of the present invention to provide a merchandise information and display tag structure of the general type discussed above which has a mounting portion adapted to be used with alternative kinds of flat bar or grid-attached hooks, for example wire-back type grid hooks, or plate-back type grid hooks.

SUMMARY OF THE INVENTION

Generally stated, the invention provides an elongate product information and display tag of the overall type discussed above, preferably being die-cut or the like from sheet plastic of the kind commonly used for such tags, and including a proximal end mounting portion for attaching the tag to a product support hook, and an elongate intermediate portion for extending over the hook and presenting product information at a distal end of the hook, suitably by way of a fold down information display portion. In accordance with the invention the mounting portion, which may fold down from the intermediate portion, is provided with a keyhole-type slot, by the top of which the mounting portion may be engaged over the distal end of a wire-back type grid hook and moved backwardly along the hook until the mounting portion is adjacent a wire bracket at the proximal end of the hook. The bottom of the keyhole-type slot is then adapted frictionally to engage around the downwardly depending stem provided on the hook. In case the stem is too long for the slot, the mounting portion may have a tearable base leading into the slot to allow the mounting portion to be separated into opposing limbs for frictionally embracing the stem. Also, the mounting portion is provided with a transverse strip of contact adhesive which may be penetrated by an aperture whereby the tag may be releasably threaded onto a plate-back type hook and adhered to the proximal end bracket of such hook. The tag is thus suitable for secure attachment to both plate-back or wire-back type grid hooks.

DESCRIPTION OF PREFERRED EMBODIMENTS

Figure 1:
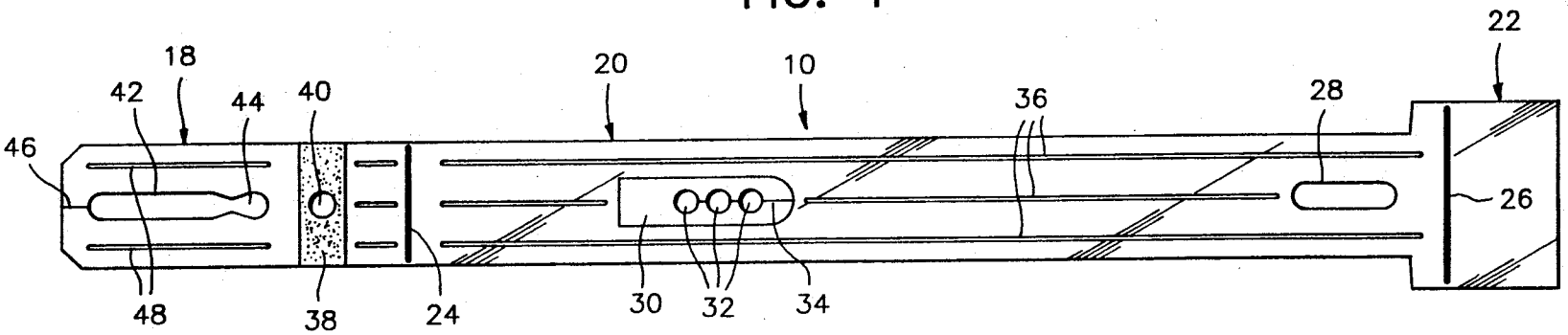
FIG. 1 is a plan view of a blank suitable for folding into a product information and display tag according to the invention.

A product information and display tag 10 for use on different kinds of grid hooks 12, 14, 16 is die-cut from plastic sheet material of a kind well known for use in such items. The tag 10 has a proximal-end mounting portion 18, an elongate portion 20 separated from the mounting portion by a first transverse bend or fold line 22 and a distal end display portion 24 separated from the intermediate portion by a second transverse bend or fold line 26.

Adjacent bend line 26, the intermediate portion 20 is formed with an elongate slot 28 for the distal end portion (such 30 as end portion 12*a*) of a hook to extend upwardly through in known manner. Closer to bend line 24 the intermediate portion is provided with an elongate cut-out fold-down stabilizing tab having a line of intercommunicating apertures 32 and a slit 34 leading into the endmost aperture from the base of the tab. The intermediate portion 20 is also formed with elongate reinforcing ribs or creases 36 promoting transverse bowing of the intermediate portion to resist flexing or bending thereof.

Figure 2:
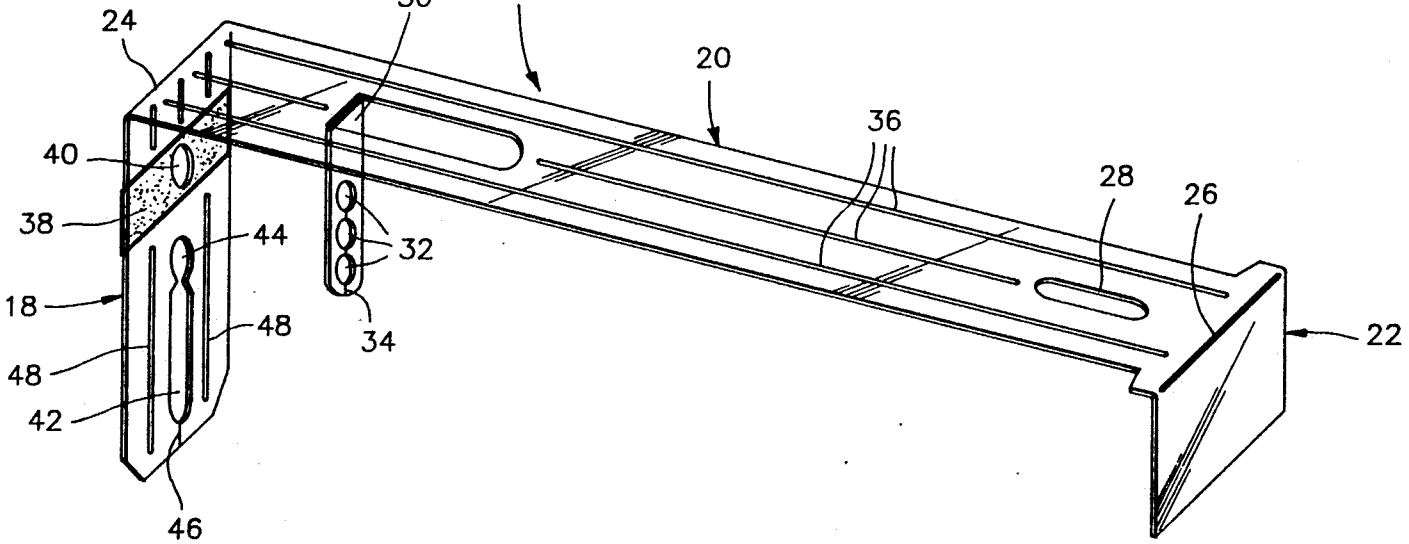
FIG. 2 is a perspective view of the blank as folded for use.
Figure 3:
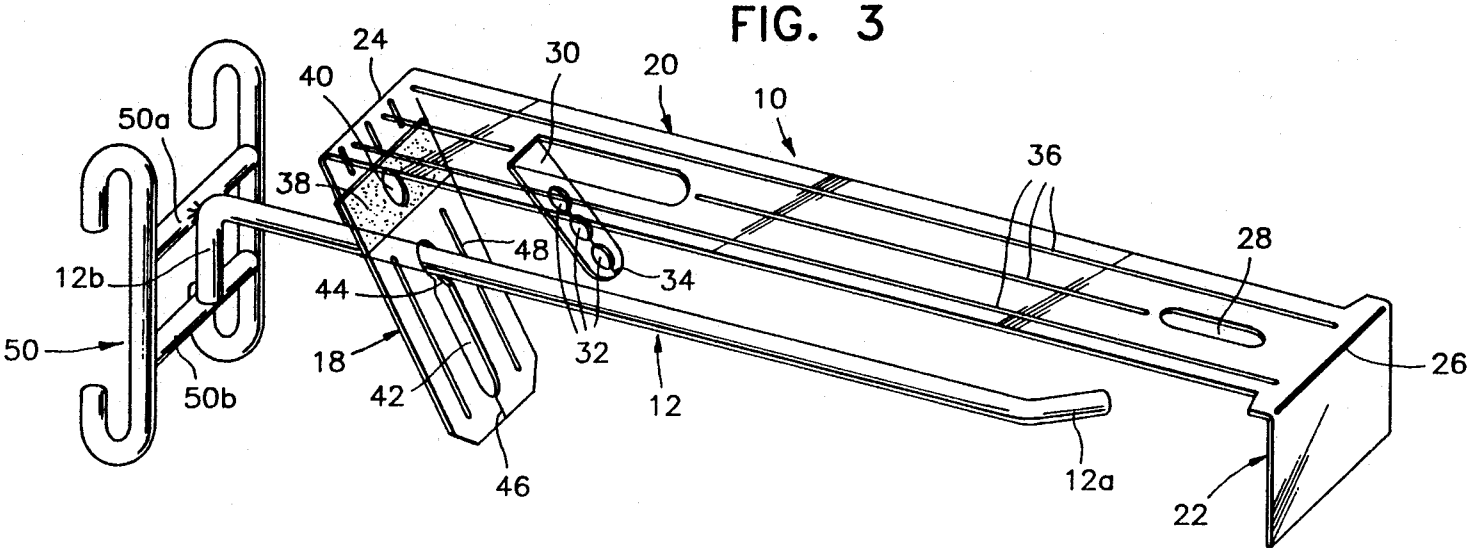
FIG. 3 is a perspective view of a wire-back grid hook showing the way in which the tag is attached.

On the upper surface of mounting portion 18 as seen in FIG. 1 (the back surface as seen in FIGS. 2 and 3), there is provided a transverse strip of contact adhesive 38 normally covered by release paper (not shown). Centrally of strip 38 there is an aperture 40 of a size to fit onto hooks 12, 14 or 16. Beyond strip 38, the mounting portion is provided with an elongate key-hole type slot 42 with an enlarged aperture 44 at its near end also suited for fitting over hooks 12, 14, or 16. A tear-away perforation 46 leading into the base of slot 42 allows the mounting portion to be separated into left and right hand limbs. The mounting portion also has elongate reinforcing ribs or creases 48.

For applying tag 10, folded into the condition shown in FIG. 2, to a wire-back grid hook 12 of the kind shown in FIG. 3, aperture 44 is engaged over the front end of the hook and the entire tag is moved back toward wire bracket 50 at the proximal end of the hook to which leg 12*b* of the hook is attached by welding, normally at the upper and lower bars 50*a* and 50*b*. Then, aperture 44 is engaged over the top weld and key-hole slot 42 is snapped over leg 12*b*. The slot is of a width so that it is a friction fit over leg 12*b*. If, however, the leg is too long to be accommodated in the slot, the mounting portion can be separated at perforation 46 into opposing limbs which embrace leg 12*b*. Finally, tab 30 is separated at perforation 34 and one of the apertures 32 engaged onto hook 12 to provide lateral stabilization of the tag. The aperture 40 and adhesive strip 38 are not used. Suitable labeling can be applied to the display portion 22.

Figure 4:
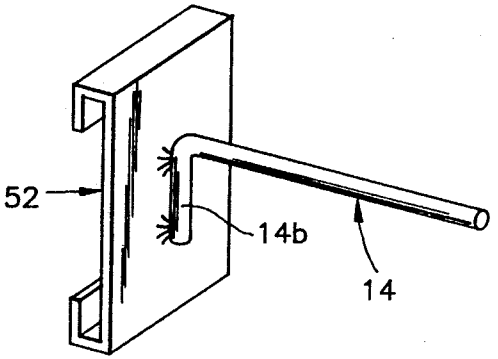
FIGS. 4 and 5 are perspective views of the proximal end portions only of different kinds of plate-back grid hooks to which the tag can be applied.

Tag 10 can be applied in similar manner to the plate-back type grid hook 14 shown in FIG. 4 having a proximal end leg 14*b* secured to a plate-like bracket 52 by upper and lower welds. In this case, aperture 44 is again engaged over the front of the hook and the tab pushed back to bracket 52. The keyhole slot 42 may again be engaged over leg 14*b*, but in this case, the mounting portion may also be adhered to bracket 52 above the hook by means of the adhesive strip 38. The tag may again be stabilized by engaging tab 30 with the hook.

Figure 5:
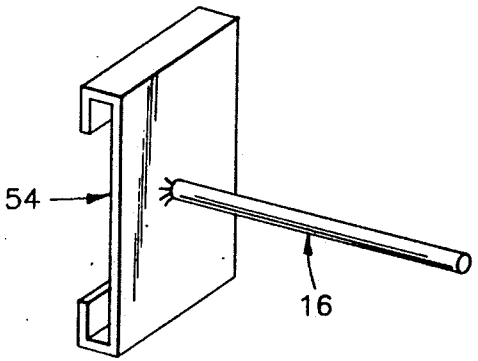

For use on a plate-back type hook as shown in FIG. 5 where the hook has no proximal end leg and the rod of the hook is welded directly to a proximal end bracket 54, aperture 40 is engaged over the front end of the hook and the adhesive strip is applied to the front face of bracket 50. The aperture 44 and keyhole slot 42 are not used in this application. The tab 30 may again be used as previously.

While only preferred embodiments of the invention have been described herein in detail, the invention is not limited thereby and modifications can be made within the scope of the attached claims.

I claim:

1. An information display tag for use in presenting product information at a distal end of a substantially horizontal wireback or plate back grid hook from which products are to be suspended, the tag comprising an elongate article of sheet material having at least a mounting portion for releasably securing the tag at a proximal end of a hook and an elongate portion adjacent the mounting portion for extending over the hook for displaying product information at the distal end of the hook wherein the mounting portion includes a first aperture adjacent the elongate portion for selective use in engaging the mounting portion onto a hook, an area of contact adhesive on a surface of the mounting portion for securing the mounting portion against a surface of a proximal end bracket of a plate -back type hook, and a second elongate aperture spaced further from the elongate portion than both the first aperture and the area of contact adhesive for selective use in engaging the mounting portion onto a hook, the elongate aperture extending toward a terminal end of the mounting portion for frictionally embracing a depending leg at the proximal end of a hook and the elongate aperture being aligned with the first aperture relative to a longitudinal axis of the tag.

2. A tag as defined in claim 1 wherein the mounting portion further includes a perforation between the elongate aperture and said terminal end for separating the mounting portion into opposing limbs suitable for embracing a leg of a hook which is too long to be accommodated in the slot.

3. A tag as defined in claim 1 wherein the first aperture is located within said area of contact adhesive.

4. A tag as defined in claim 3 wherein said area is a transverse strip of contact adhesive extending across the mounting portion.

5. A tag as defined in claim 1 wherein the elongate portion includes a fold-down tab with means for engaging onto a hook to laterally stabilize the tag.

6. A tag as defined in claim 5 wherein the means for engaging comprises at least one aperture in the tab and a perforation between said aperture and a free end of the tab whereby the tab can be split into opposing limbs.

7. A tag as defined in claim further including an information display portion at a distal end of the intermediate portion.

8. A tag as defined in claim 7 wherein the mounting portion and the display portion are separated from the intermediate portion by respective transverse bend lines.

9. A tag as defined in claim 1 including longitudinally extending reinforcing means on at least one of the mounting portion and the intermediate portion.

10. A tag as claimed in claim 1 in combination with a wire-back grid hook having a proximal end depending leg welded to respective upper and lower rods of a proximal end hook bracket wherein said second aperture of the mounting portion is engaged over the hook and embraces the leg of the hook, and the mounting portion effectively engages said bracket.

11. A tag as claimed in claim 1 in combination with a plate-back grid hook having a proximal end depending leg welded to a plate-like proximal end bracket wherein said second aperture of the mounting portion is engaged over the hook, the mounting portion engages a front surface of said bracket and the area of contact adhesive is applied to the front surface of the bracket above the hook.

12. A tag as claimed in claim 1 in combination with a plate-back grid hook having a proximal end of a hook welded endwise directly to a plate-like bracket wherein said first aperture of the mounting portion is engaged over the hook, the mounting portion engages a front face of the bracket and said area of contact adhesive is applied to the front surface of the bracket.

13. In combination, an elongate product support hook for suspending products therefrom, and an elongate information display tag for presenting product information at a distal end of the hook wherein the hook has a proximal end, a depending leg at said proximal end and a hook mounting bracket secured to said leg, wherein the tag has a mounting portion securing the tag to the proximal end of the hook and an elongate portion extending from the mounting portion over and along the hook, wherein the mounting portion includes an elongate aperture engaged over the hook extending lengthwise around the depending leg of the hook and embracing the leg with a friction fit.

14. A combination as defined in claim 13 wherein the aperture has a tapering portion embracing the leg of the hook.

* * * * *